US008057271B2

(12) United States Patent
Hevesi et al.

(10) Patent No.: US 8,057,271 B2
(45) Date of Patent: Nov. 15, 2011

(54) PADDLE BLADE AND SHAFT I-BEAM JOINT

(76) Inventors: John Hevesi, Minden (CA); Steve Horvath, Uxbridge (CA)

( * ) Notice: Subject to any disclaimer, the term of this patent is extended or adjusted under 35 U.S.C. 154(b) by 0 days.

(21) Appl. No.: 12/429,336

(22) Filed: Apr. 24, 2009
(Under 37 CFR 1.47)

(65) Prior Publication Data

US 2010/0279560 A1 Nov. 4, 2010

(51) Int. Cl.
*B63H 16/04* (2006.01)

(52) U.S. Cl. ..... 440/101; 416/74

(58) Field of Classification Search ..... 440/101; 416/70 R, 74
See application file for complete search history.

(56) References Cited

U.S. PATENT DOCUMENTS

| | | | | |
|---|---|---|---|---|
| 1,789,749 | A | 1/1931 | Herring | |
| 2,343,726 | A | 3/1944 | Witt | |
| 4,147,469 | A * | 4/1979 | Sherberne | 416/70 R |
| 6,261,141 | B1 * | 7/2001 | Heap | 440/101 |
| 6,796,862 | B1 * | 9/2004 | Abbenhouse et al. | 440/101 |
| 6,991,501 | B2 | 1/2006 | Wilce | |
| 7,309,364 | B1 | 12/2007 | Wagenknecht et al. | |
| 2005/0101200 | A1 | 5/2005 | Townsend | |

* cited by examiner

*Primary Examiner* — Lars A Olson
(74) *Attorney, Agent, or Firm* — Patton Boggs LLP

(57) ABSTRACT

A paddle including a shaft having a distal end, the distal end ending in a protrusion; and a paddle blade having a proximal end joined to the distal end of the shaft, the proximal end having an inner surface and at least one internal longitudinal slot disposed adjacent to the inner surface engaged with the protrusion.

13 Claims, 2 Drawing Sheets

PADDLE BLADE AND SHAFT I-BEAM JOINT

BACKGROUND

Without limiting the scope of the invention, its background will be described in relation to a joint between a paddle blade with a shaft, as an example.

Known paddles have shafts that join with blades by fitting the cylindrical shaft into the cylindrical opening of the blade and then joining them together with fasteners, adhesives, and the like. Thus, the structural integrity and support of the joint of the blade and shaft comes from the connection of concentric cylinders. Accordingly, the structural integrity at this paddle I-beam joint is limited.

SUMMARY

The above-described problems are solved and a technical advance is achieved by the paddle blade and shaft I-beam joint ("paddle I-beam joint") disclosed in this application. In one embodiment, the present paddle I-beam joint is in a paddle including a shaft having a distal end, the distal end ending in a protrusion; and a paddle blade having a proximal end joined to the distal end of the shaft, the proximal end having an inner surface and at least one internal longitudinal slot disposed adjacent to the inner surface engaged with the protrusion. In one aspect, the protrusion may be an extension of the shaft. In another aspect, the shaft may be a tubular material having a wall thickness.

Preferably, the at least one internal longitudinal slot may be formed by longitudinal extensions formed on the inner surface of the paddle blade. Additionally, the outer diameter of the distal end of the shaft may be less than the inner diameter of the proximal end of the paddle blade. In yet another aspect, the wall thickness of the tubular material is less than the width of the at least one internal longitudinal slot.

In another embodiment, the present paddle I-beam joint may be included in a paddle blade including a body having a distal end and a proximal end, the body having an inner surface; and at least one slot disposed longitudinally along the inner surface, the opening of the at least one slot extending towards the proximal end for engaging a distal end of a shaft of a paddle. In one aspect, the at least one slot may be formed by extensions of a rib disposed within the body and the inner surface of the body. In another aspect, the at least one slot may have a width slightly greater than the cross-sectional width of a longitudinal wall of the shaft. In yet another aspect, the at least one slot may be disposed distally a distance from the proximal end of the body. Preferably, the inner surface of the body may have a substantially circular cross-sectional profile and the extensions extend from the inner surface inwardly towards the center of the substantially cross-sectional profile. Also preferably, a portion of the extension is part of the inner surface of the body and a portion of the extension may extend detached substantially parallel to the inner surface of the body. In still yet another aspect, the at least one slot disposed longitudinally along the inner surface includes a longitudinal rib extending from a first portion of the inner surface of the body to a second portion of the inner surface of the body, the longitudinal rib proximally terminating in two opposing longitudinal slots.

In yet another embodiment, the present paddle I-beam joint may be included in a paddle blade including a body having a distal end and a proximal end, the body having opposing inner surfaces; a longitudinal rib disposed within the inner surface extending laterally between the opposing inner surfaces; and at least two slots located adjacent to the opposing inner surfaces and terminating at the proximal end of the longitudinal rib, the at least two slots for retaining the distal end of a wall of a substantially cylindrical shaft. Preferably, the proximal end may have a substantially circular cross-section shape. Also, the proximal end may be tubular-shaped. Additionally, the at least two slots are formed by one of the two opposing inner surfaces and extensions from the longitudinal rib. Further, the openings of the at least two slots may be slightly greater than the wall thickness of the substantially cylindrical shaft. In addition, the at least two slots may be disposed distally a distance from the proximal end of the body. Preferably, the at least two slots are formed by opposing distal extensions extending longitudinally a distance from the two opposing inner surfaces.

BRIEF DESCRIPTION OF THE DRAWINGS

For a more complete understanding of the features and advantages of the paddle I-beam joint, reference is now made to the detailed description of the invention along with the accompanying figures in which corresponding numerals in the different figures refer to corresponding parts and in which.

DETAILED DESCRIPTION OF THE DRAWINGS

Figure 1:
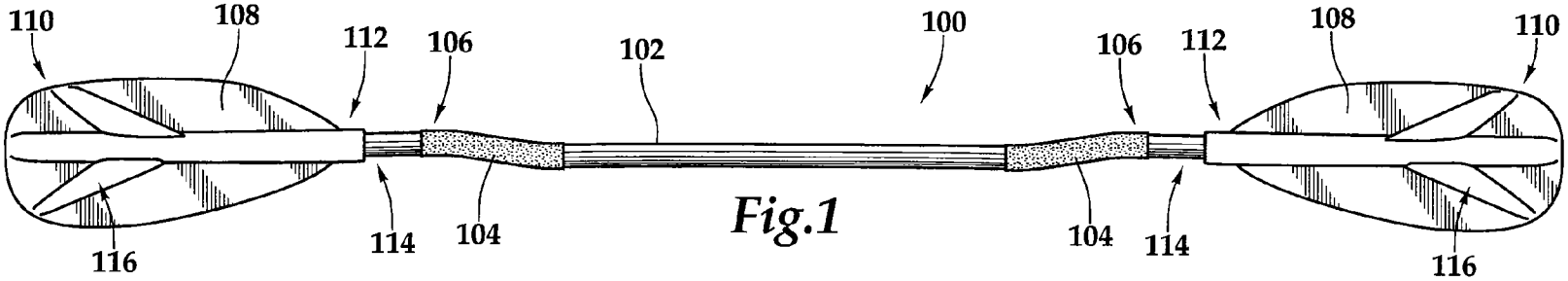
FIG. 1 is an illustration of a front view of a paddle having a paddle I-beam joint according to one embodiment.

Before describing the paddle I-beam joint in detail, a paddle in which the invention operates is described in connection with FIG. 1. FIG. 1 is a diagram of a paddle 100 having a shaft 102 that extends between a paddle blade 108 located at a distal end 114 each end of shaft 102. Shaft 102 may further include a grip 104 located distally from the center point of shaft 102 on either end of shaft 102. Grips 104 may be incorporated into an ergonomic bend 106 of shaft 102 for improved comfort and performance by a user. Paddle blades 108 have a distal end 110 and a proximal end 112, proximal end 112 being joined to distal end 114 of shaft 102. A skeleton 116 provides a rigid support for paddle blade 108.

Figure 2:
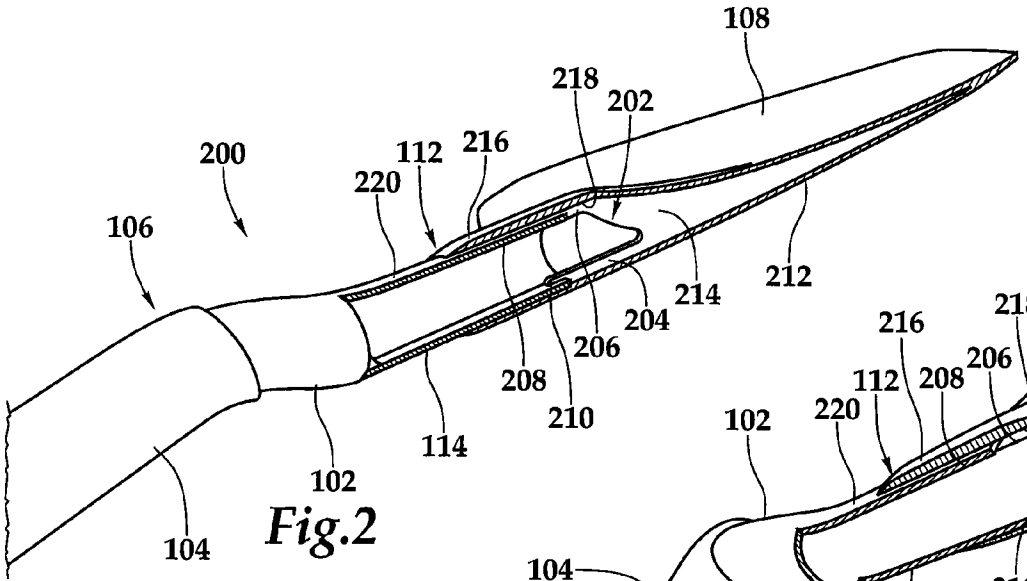
FIG. 2 is an illustration of a partial cross-sectional view of a paddle I-beam joint according to one embodiment.
Figure 3:
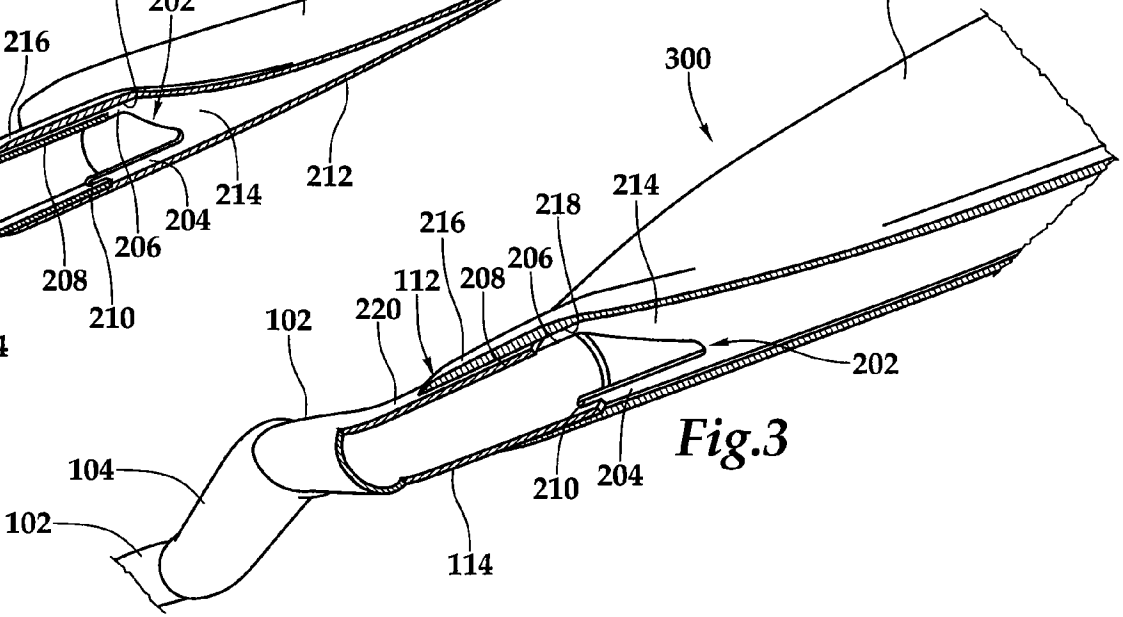
FIG. 3 is an illustration of a partial cross-section view of paddle I-beam joint of FIG. 2 according to one embodiment.

Referring now to FIGS. 2-3, embodiments 200 and 300 of a paddle I-beam joint 202 connects paddle blade 108 to shaft 102 is shown. Paddle I-beam joint 202 may have a longitudinal rib 214 that preferably extends between a top surface and bottom surface of body 212 of paddle blade 108. Paddle I-beam joint 202 has an extension 204 that extends longitudinally from longitudinal rib 214 along an inner surface 218 of body 212. In addition, paddle I-beam joint 202 has another extension 204 that extends longitudinally from longitudinal rib 214 along inner surface 218 of body 212. Distal end 114 of shaft 102 has an inner surface 208 and an outer surface 220 that may fit within inner surface 218 of body 212. Extension 204 includes a tab 210 that extends from extension 204; tab 210 creates a slot 602 (FIG. 6) located between tab 210 and inner surface 208 of body 212 of paddle blade 108 for accepting and retaining distal end 114 of shaft 102.

Figure 4:
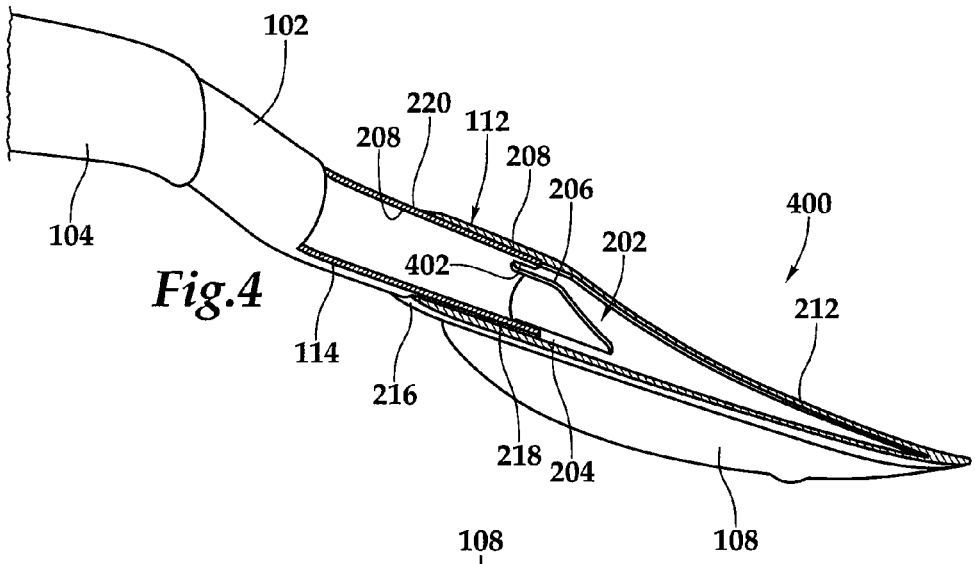
FIG. 4 is an illustration of a partial cross-sectional view of paddle I-beam joint of FIG. 2 according to one embodiment.
Figure 5:
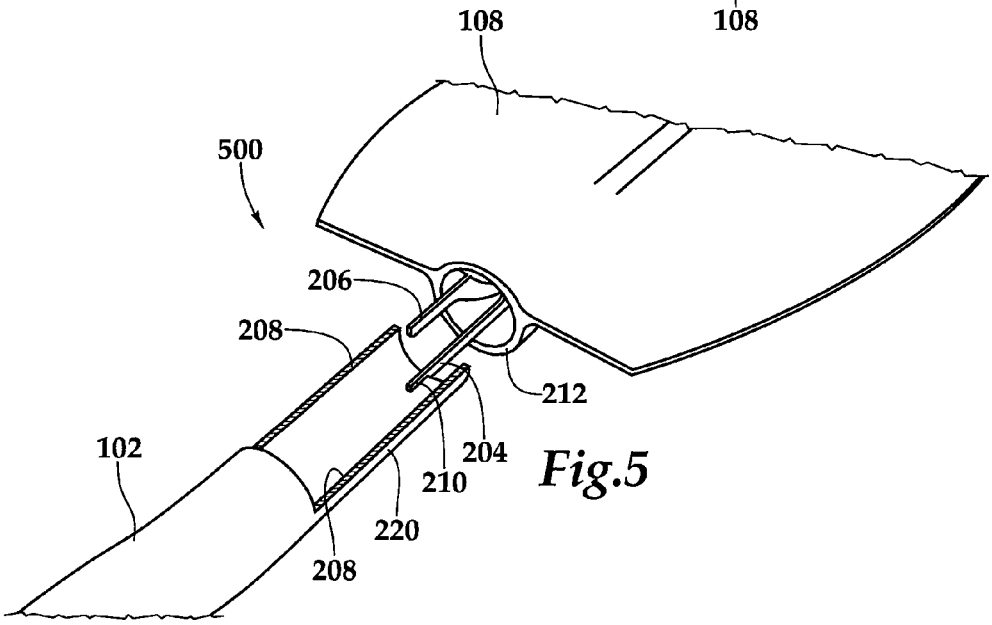
FIG. 5 is an illustration of a partial cross-sectional view of paddle I-beam joint of FIG. 2 where a portion of an outer surface of paddle blade is removed according to one embodiment.

Turning now to FIG. 4, an embodiment 400 of paddle I-beam joint 202 is shown. Extension 206 has a tab 402 that extends from extension 206; tab 402 creates a slot 602 located between inner surface 208 of body 212 of paddle blade 108 for accepting and retaining distal end 114 of shaft 102. FIG. 5 is an embodiment 500 of paddle I-beam joint 202 where a portion of body 212 has been removed or truncated to show extension 204, tab 210, and extension 206.

Figure 6:
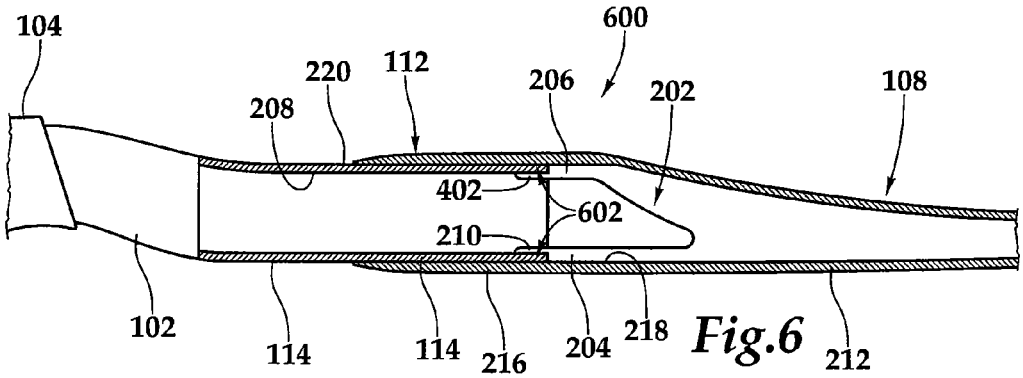
FIG. 6 is an illustration of a side cross-sectional view of paddle I-beam joint of FIG. 2 according to one embodiment.

Referring now to FIG. 6, an embodiment 600 of paddle I-beam joint 202 is shown. Slots 602 are created by tab 402 and tab 210 extending longitudinally from extension 206 and tab 210, respectively. Distal end 114 of shaft 102 extends a distance into proximal end 112 of paddle blade 108 and engages or fits into slots 602 for providing an improved structural integrity, rigidity, and connection of shaft 102 to paddle blade 108. Preferably, the lateral distance of slots 602 is slightly greater than the cross-sectional thickness of distal end 114 of shaft 102.

Longitudinal rib 214 preferably extends from the top of inner surface 218 of body 212 to the bottom of inner surface 218 of body 212. Longitudinal rib 214 may be itself an extension of one of the ribs of skeleton 116, such as the main or middle longitudinal rib of skeleton 116. Slots 602 may be any length and are formed by the void created by tab 402 and inner surface 208 and tab 210 and inner surface 208. The width of slot 602 may be any distance desirable for retaining the cross-sectional thickness of distal end 114 of shaft 102. For example, if shaft 102 is made from a particular tubular material, the thickness of the wall of the tubular material would be approximately equal to width or distance of slots 602. Preferably, slot 602 has a width of slightly greater distance than the cross-sectional thickness of shaft 102.

Slots 602 preferably have an opening just slight larger than the wall thickness of shaft 102 as best illustrated in FIG. 6. In this figure, the cross-sectional thickness of distal end 114 is shown as the distance between outer surface 220 and inner surface 208 of distal end 114. In one embodiment, shaft 102 may be a cylindrical shaft or substantially cylindrical shaft made of a tubular material having a particular wall thickness that snugly fits into slots 602 for retention by slots 602. In another embodiment, shaft 102 may be a solid cylindrical material or substantially cylindrical material having an cylindrically walled extension disposed or located on the distal end of shaft 102 for engaging in slots 602.

Paddle blades 108 may utilize, for example, separate injection molded components (e.g., two or more) that may be locked together. Generally, skeleton 116 supports outer surface 216 of paddle blade 108. Skeleton 116 may be stiff to reinforce paddle blades 108, while outer surface 216 may be strong to provide abrasion resistance. Paddle blades 108 may thus be configured to be lighter, stronger and/or of higher performance than those currently available. Additionally, skeleton 116 (e.g., a stiff plastic skeleton) may be used as a component of the paddle blade 108. Skeleton 116 may include one or more ribs that reinforce the blade longitudinally and/or laterally. Skeleton 116 may also be injection molded and the injection molded material may be plastic and/or a composite material. Skeleton 116 may provide the blade with an overall stiffness, for example, similar to that of high performance composite paddle blades having a higher price.

Outer surface 216 of paddle blade 108 may include a plastic and/or a polycarbonate (e.g., a clear tinted polycarbonate), for example, for the skin and/or body of paddle blade 108. A polycarbonate skin may provide paddle blade 108 with a tough outer surface and an appealing look. Skeleton 116 may include a stiffer material (e.g., stiffer plastic) than included in the outer surface 216 to provide added stiffness.

Outer surface 216 may be molded (e.g., injection molded) over skeleton 116 to form paddle blade 108. The skeletal reinforcement may be configured, for example, so that material (e.g., plastic) flow over its surface is not impeded by the structure itself. The cross sections of a skeletal rib may be configured as an airfoil or "wing" shaped. The cross sections allow, for example, molten plastic to travel over its surface without turbulence. The lack of turbulence minimizes the possibility of trapping air within the resulting molded part and permits the use of clear plastic to be injection molded onto skeleton 116 without the presence of large voids being formed within the part.

The skeletal reinforcement may be configured to provide support not only to distal end 110 of paddle blade 108, but also in three distinct directions. FIG. 1 illustrates a multi-pronged (e.g., three-pronged) skeleton 116 that provides structural support to the longitudinal end of paddle blade 108 and/or the outer tips of paddle blade 108. Skeleton 116, for example, may provide the largest amount of structural support to the distal end 110 of paddle blade 108 with the least amount of material. This will enable paddle blade 108 to have the lowest mass for a required strength.

Outer surface 216 of paddle blade 108 may be molded over skeleton 116, for example, in a secondary molding operation that secures the skeletal reinforcement within (e.g., entirely within) a shell (e.g., plastic outer shell). The shell provides paddle blade 108 an outer structure, in whole or in part, and is configured to mold over skeleton 116 with a uniform thickness. Outer surface 216 of paddle blade 108 interacts with the environment, for example, while paddling and is the component of paddle blade 108 that takes the abrasion abuse associated with paddle sports. As such, outer surface 216 may be molded from a high impact plastic such as, for example, polycarbonate that can provide resistance to impact damage while allowing a unique cosmetic appearance.

Shaft 102 may include a composite shaft that is molded and/or bent, ergonomic bend 106, to be ergonomically configured. Grip 104 may be a molded grip and/or handlebar grip, as is commonly known to those skilled in the art. Shaft 102 and grip 104 are illustrated to be configured such that the orientation and location of grip 104 on shaft 102 allow for the correct ergonomic position of the paddler's or user's hands on shaft 102. Grip 104 may be injection molded separately and/or attached to shaft 102 in a separate operation.

Shaft 102 may include a surface profile, for example, along a gripping section configured to accept a complimentary gripping component. The surface profile may lock grip 104 into position, for example, along the axis of shaft 102 in a longitudinal direction and/or latitudinal (e.g., arcuate) direction. The surface profile is configured, for example, so as to prevent the movement of the grip 104 in one or more planes and/or directions once installed.

Shaft 102 may include one or more bends such as, for example, ergonomic bends 106, as illustrated in FIG. 1. The bends may be configured so as to provide a proper ergonomic alignment and placement of the grip, relative the user. An offset angle of the gripping section of shaft 102 may be between about 8 and 17 degrees (or more or less) from a centerline of shaft 102. A centerline of paddle blade 108 may be oriented, for example, so as to bisect the center of the gripping section.

An internal surface of grip 104 may be configured to lock into position at the corresponding location on shaft 102. The outer surface of grip 104 may be configured, for example, with an oval profile to accommodate the users hand in a comfortable manner. Grip 104 may be offered in a plurality of distinct sizes to accommodate users with small and large hands. The interlocking surfaces allow the interchangeability of grip sizes by the end user.

Shaft 102 may also include one of (i) a groove (e.g., slot) and (ii) a projection (e.g., lug), and the grip may include the other one of (i) the groove and (ii) the projection to engage the one of (i) the groove and (ii) the projection of the shaft to secure the grip to the shaft.

Paddle blade 108 may include a multi-component injection molded design. Skeleton 116 may provide reinforcement, while a strong outer surface 216 may provide abrasion resistance. Paddle 100 (e.g., a kayak paddle) may include paddle blade 108 and also shaft 102 (e.g., a composite bent shaft) with a gripping area configured to accommodate a grip with a complimentary gripping area. The grip may be located on the shaft in a predetermined orientation and location. Other structures such as, for example, a handlebar (e.g., a bicycle handlebar), a ski pole, a shovel, etc. may include the shaft and/or the grip.

The previous detailed description is of a small number of embodiments for implementing the paddle I-beam joint and is not intended to be limiting in scope. One of skill in this art will immediately envisage the methods and variations used to implement this invention in other areas than those described in detail. The following claims set forth a number of the embodiments of the paddle I-beam joint disclosed with greater particularity.

What is claimed:

1. A paddle blade comprising:

a body having a distal end and a proximal end, the body having an inner surface; and at least one slot disposed longitudinally along the inner surface, an opening of the at least one slot extending towards the proximal end for engaging a distal end of a shaft of a paddle, wherein the at least one slot disposed longitudinally along the inner surface comprises: a longitudinal rib extending from a first portion of the inner surface of the body to a second portion of the inner surface of the body, the longitudinal rib proximally terminating in two opposing longitudinal slots.

2. The paddle blade of claim 1, wherein the at least one slot is formed by extensions of a rib disposed within the body and the inner surface of the body.

3. The paddle blade of claim 2, wherein the inner surface of the body has a substantially circular cross-sectional profile and the extensions extend from the inner surface inwardly towards the center of the substantially cross-sectional profile.

4. The paddle blade of claim 2, wherein a portion of the extension is part of the inner surface of the body and a portion of the extension extends detached substantially parallel to the inner surface of the body.

5. The paddle blade of claim 1, wherein the at least one slot has a width slightly greater than the cross-sectional width of a longitudinal wall of the shaft.

6. The paddle blade of claim 1, wherein the at least one slot is disposed distally a distance from the proximal end of the body.

7. A paddle blade comprising:

a body having a distal end and a proximal end, the body having opposing inner surfaces;

a longitudinal rib disposed within the inner surface extending laterally between the opposing inner surfaces; and at least two slots located adjacent to the opposing inner surfaces and terminating at a proximal end of the longitudinal rib, the at least two slots for retaining the distal end of a wall of a substantially cylindrical shaft.

8. The paddle blade of claim 7, wherein the proximal end has a substantially circular cross-section shape.

9. The paddle blade of claim 7, wherein the proximal end is tubular-shaped.

10. The paddle blade of claim 7, wherein the at least two slots are formed by one of the two opposing inner surfaces and extensions from the longitudinal rib.

11. The paddle blade of claim 7, wherein openings of the at least two slots are slightly greater than the wall thickness of the substantially cylindrical shaft.

12. The paddle blade of claim 7, wherein the at least two slots are disposed distally a distance from the proximal end of the body.

13. The paddle blade of claim 7, wherein the at least two slots are formed by opposing distal extensions extending longitudinally a distance from the two opposing inner surfaces.

* * * * *